US011186079B2

(12) United States Patent
Arnold et al.

(10) Patent No.: US 11,186,079 B2
(45) Date of Patent: Nov. 30, 2021

(54) OSCILLATING ROLLER AND PRINTING PRESS HAVING A PLURALITY OF PRINTING UNITS THAT HAVE SUCH A ROLLER

(71) Applicant: KOENIG & BAUER AG, Würzburg (DE)

(72) Inventors: Christian Arnold, Rimpar (DE); Bernd Masuch, Kürnach (DE); Wolfgang Reder, Veitshöchheim (DE); Helmut Schmidt, Wertheim (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/640,847

(22) PCT Filed: May 22, 2018

(86) PCT No.: PCT/EP2018/063324
§ 371 (c)(1),
(2) Date: Feb. 21, 2020

(87) PCT Pub. No.: WO2019/048088
PCT Pub. Date: Mar. 14, 2019

(65) Prior Publication Data

US 2020/0376829 A1 Dec. 3, 2020

(30) Foreign Application Priority Data

Sep. 8, 2017 (DE) ..... 10 2017 215 920.0
Jan. 11, 2018 (DE) ..... 10 2018 200 333.5

(51) Int. Cl.
*B41F 31/15* (2006.01)
*B41F 31/26* (2006.01)
*B41F 31/00* (2006.01)

(52) U.S. Cl.
CPC ..... *B41F 31/15* (2013.01); *B41F 31/26* (2013.01); *B41F 31/004* (2013.01);
(Continued)

(58) Field of Classification Search
CPC ..... B41F 31/15; B41F 31/26; B41F 31/004; B41P 2213/734; B41P 2227/60; B41P 2231/10; Y10S 101/38
See application file for complete search history.

(56) References Cited

U.S. PATENT DOCUMENTS 5,125,340 A 6/1992 Moore
5,134,939 A 8/1992 Borne
(Continued)

FOREIGN PATENT DOCUMENTS

DE 3800658 A1 7/1989
DE 69110808 T2 11/1995
(Continued)

OTHER PUBLICATIONS

International Search Report of PCT/EP2018/063324 dated Aug. 16, 2018.

*Primary Examiner* — Leslie J Evanisko
*Assistant Examiner* — Leo T Hinze
(74) *Attorney, Agent, or Firm* — Mattingly & Malur, PC

(57) ABSTRACT

A roller for a printing unit of a printing press, has a roller outer body, which is mounted on a roller inner body, so as to be movable axially in a reciprocating manner. For the axial movement of the roller outer body, in at least a first direction, a pneumatic drive is provided. The pneumatic drive has at least one first chamber, which is mounted in the interior of the roller in the manner of a cylinder/piston system between one or more structural elements, that are fixed to the roller outer body, and one or more structural elements that are fixed to the roller inner body. The chamber
(Continued)

can be pressurized with compressed air. The parts of the structural elements adjoining the chamber, and that are movable axially relative to one another, form a non-contact seal between themselves on their mutually facing sides.

11 Claims, 7 Drawing Sheets

(52) U.S. Cl.
CPC ..... *B41P 2213/734* (2013.01); *B41P 2227/60* (2013.01); *B41P 2231/10* (2013.01)

(56) References Cited

U.S. PATENT DOCUMENTS

| | | | | |
|---|---|---|---|---|
| 5,727,469 | A | 3/1998 | Mohrmann | |
| 9,895,876 | B2 * | 2/2018 | Behnke ..... | B41F 27/1231 |
| 2007/0068406 | A1 | 3/2007 | Hartmann et al. | |
| 2017/0190169 | A1 | 7/2017 | Behnke et al. | |

FOREIGN PATENT DOCUMENTS

| | | | |
|---|---|---|---|
| DE | 19539502 | A1 | 5/1997 |
| DE | 19603765 | A1 | 8/1997 |
| DE | 102005040614 | A1 | 3/2007 |
| DE | 102006026346 | A1 | 12/2007 |
| EP | 0453847 | A1 | 10/1991 |
| EP | 0476379 | A1 | 3/1992 |
| EP | 0770482 | A2 | 5/1997 |
| EP | 1757447 | A2 | 2/2007 |
| WO | 2016/008705 | A1 | 1/2016 |

* cited by examiner

OSCILLATING ROLLER AND PRINTING PRESS HAVING A PLURALITY OF PRINTING UNITS THAT HAVE SUCH A ROLLER

CROSS REFERENCE TO RELATED APPLICATIONS

This application is the U.S. National Phase, under 35 U.S.C. § 371, of PCT/EP2018/063324, filed May 22, 2018; published as WO 2019/048088 A1 on Mar. 14, 2019, and claiming priority to DE 10 2017 215 920.0, filed Sep. 8, 2017 and to DE 10 2018 200 333.5, filed Jan. 11, 2018, the disclosures of which are expressly incorporated herein in their entireties by reference.

FIELD OF THE INVENTION

The present invention relates to an oscillating roller and to a printing press having printing units that have such a roller. A roller for a printing unit of a printing press has a roller outer body which is mounted on a roller inner body so as to be movable axially in a reciprocating manner. For the axial movement of the roller outer body, in at least a first direction, a pneumatic drive is provided. The pneumatic drive has at least one first chamber which is formed in the interior of the roller, in the manner of a cylinder/piston system between one or more structural elements that are fixed to the roller outer body, and one or more structural elements that are fixed to the roller inner body, and which can be pressurized with compressed air. The printing press is usable for decorating hollow objects, each of which has a cylindrical lateral surface. The printing press uses a plurality of printing units, each of which comprises a forme cylinder and an inking unit and which inking units cooperate, via the forme cylinder, with the same printing blanket of a device for transferring the printing ink to the hollow objects to be printed.

BACKGROUND OF THE INVENTION

From DE 196 03 765 A1 an oscillating roller is known, the outer body of which, comprising the lateral surface of said roller, can be moved on an axis in a reciprocating manner by applying compressed air to two chambers formed in the roller interior. The chambers are sealed against one another and against the outside by seals. Another oscillating roller based on the same principle is disclosed by EP 0 453 847 A1.

As is known from WO 2016/008705 A1, for example, in a device or a printing press used in the packaging industry for decorating hollow objects, each of which has a cylindrical lateral surface, in most cases a plurality of printing units are used. In such cases, each of these printing units transfers a printing ink onto a printing blanket, which is used jointly by these printing units. The lateral surface of the hollow object in question is then decorated with a print motif, e.g. a multicolored print motif, by a relative movement between the lateral surface of the hollow object in question and the printing blanket, in particular by rolling the lateral surface of the hollow object in question along said printing blanket, which has been inked-up in advance, in particular with multiple colors. In the printing units, the respective printing forme cylinder receives the printing ink via an inking unit comprising a plurality of rollers, at least one of which is embodied as an oscillating roller, in particular as an oscillating rider roller.

DE 691 10 808 T2 discloses an oscillating roller that is moved axially in a reciprocating manner by the alternating pressurization of two piston chambers provided at the two ends of a piston. In one exemplary embodiment, the piston/piston chamber system is arranged inside the roller body, with the piston being fixed to the axle and the bases of the piston chambers being fixed axially movably on the axle on the inside of the roller outer body.

DE 196 03 765 A1 discloses a device for imparting axial movement to a distribution roller, wherein in one exemplary embodiment, in the interior of the distribution roller, a sealing wall is non-rotationally and axially fixed on an axially stationary and non-rotational axle, and is adjoined on both sides by hollow spaces that can be pressurized with compressed air to induce oscillation of the outer body. Between those parts that are movable axially relative to one another, seals are provided.

DE 10 2005 040 614 A1 relates to an oscillating roller, the interior of which can be temperature controlled by the supply and removal of temperature control medium. The single axle running through the center of the roller is mounted in side frame sections such that it can be rotated and displaced axially. To prevent contamination of the bearing that supports the axle in the frame, the bearing is protected by a labyrinth seal that absorbs axial relative movement between frame and roller. The oscillation drive, which engages via a roller chain, operates counter to a compression spring arranged between the roller and the radial bearing.

In DE 195 39 502 A1 as well, the journal of an oscillating roller is mounted in the frame to enable axial and rotational movement. To prevent lubricant that is fed into the bearing assembly from leaking out, a labyrinth seal is provided between the axles and the bearing bushing, which is fixed to the frame.

DE 10 2006 026 346 A1 relates to a hydraulic lift drive for an axially oscillating roller, in which the oscillation of the roller in one direction is implemented by pressurizing an internal piston chamber with a fluid from a hydraulic pump. A return in the other direction is accomplished by means of a compression spring, which is arranged between the roller outer body and a retaining ring provided on the stationary roller axle.

SUMMARY OF THE INVENTION

The object of the present invention, is to devise an improved oscillating roller and a printing press having printing units that have such a roller.

The object is achieved, according to the present invention by the provision of the parts of the structural elements delimiting the chamber, and that are movable axially relative to each other, forming a non-contact seal between themselves on their mutually facing sides. The inking unit comprises a distribution roller which includes the roller outer body that is mounted on the roller inner body so as to be movable in a reciprocating manner.

One advantage of a roller that is driven by a pneumatic drive, i.e., an oscillating roller, is its low cost relative to mechanical drive solutions. Since the oscillation drive is integrated into the roller, the drive does not require any additional space. It is also particularly easy to retrofit. Such a roller also functions with very little wear.

Of particular advantage is an embodiment that has a sealing system embodied as partially, predominantly, or even completely contactless. This sealing system, which is at least partially or even completely contactless, does not result in any additional friction-induced heat generation. And ultimately, due to the reduced friction of a sealing system that is partially or completely contactless, no additional force is required to overcome the friction in order to generate the oscillating stroke.

BRIEF DESCRIPTION OF THE DRAWINGS

An exemplary embodiment of the invention is illustrated in the set of drawings and will be described in greater detail below.

The description of the roller according to the invention will be presented in conjunction with a particularly advantageous use thereof in a printing unit of a printing press for printing on hollow objects, in particular a can printing press; however, said roller is generally not limited to this use per se.

In the drawings:

FIG. 1 shows a device for printing on or decorating hollow objects that each have a lateral surface, using a plurality of inking units;

FIG. 2 shows an inking unit, in particular for the device shown in FIG. 1, in a first operating position;

FIG. 3 shows the inking unit in particular for the device shown in FIG. 1, in a second operating position;

FIG. 4 shows a chamber doctor blade system, in particular for the inking unit depicted in FIGS. 2 and 3;

FIG. 5 shows an oblique view of a distribution roller;

FIG. 6 shows a sectional view of a roller according to FIG. 5, and

FIG. 7 shows a sectional view of an alternative embodiment of a roller in accordance with the present invention.

DESCRIPTION OF THE PREFERRED EMBODIMENT

Figure 1:
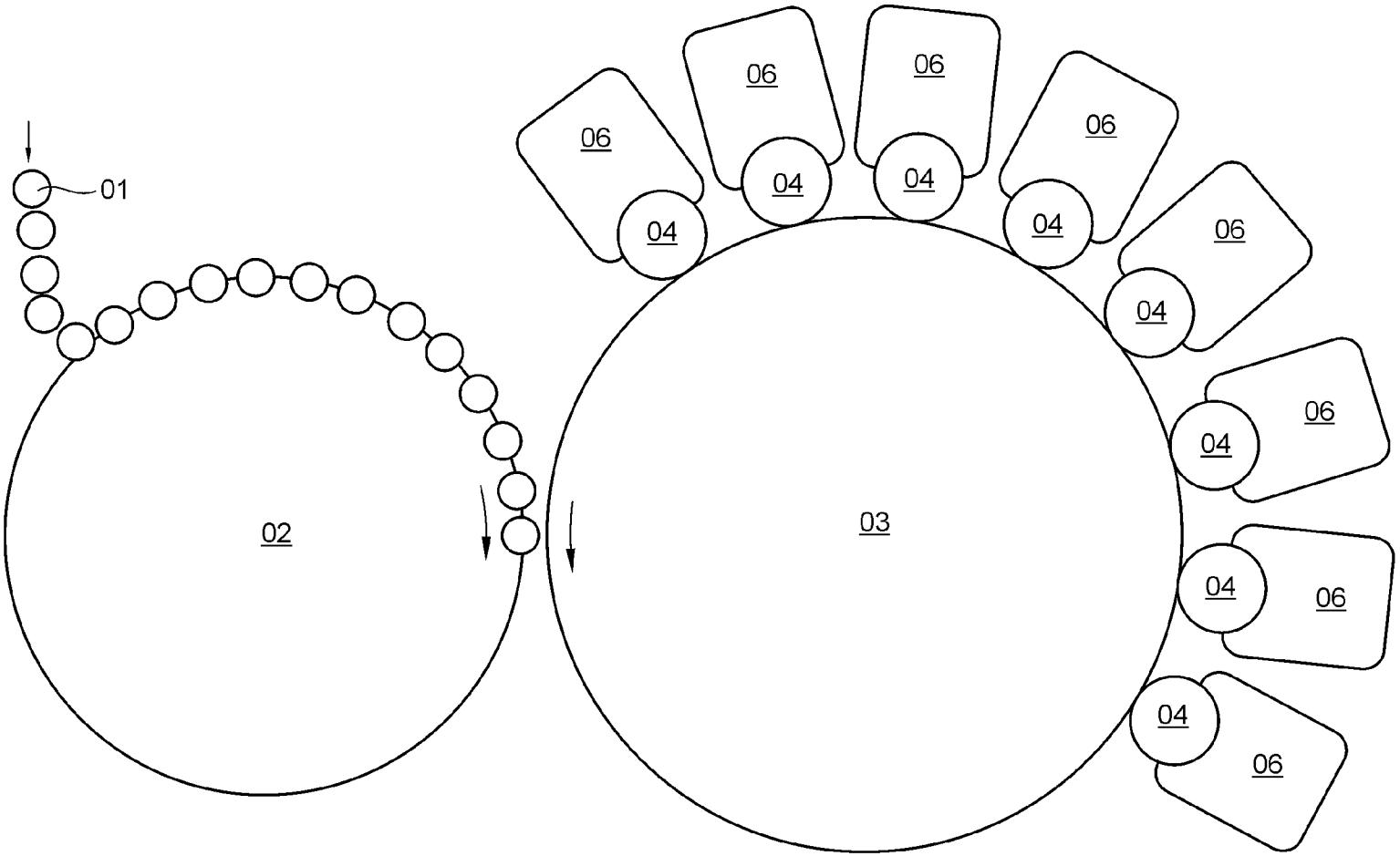

FIG. 1 shows a simplified schematic representation of an example of a device for printing on or for decorating hollow objects 01, e.g. two-part cans 01, each having a preferably cylindrical lateral surface, in particular, wherein said hollow objects 01 are fed, e.g. sequentially, by means of a conveyor device to the transport device configured, e.g. as a rotating or at least rotatable feed wheel, in particular as a mandrel wheel 02, and are held individually on said transport device, each on a holder. In the following, based on the selected exemplary embodiment of the printing press or the device included therein for printing on hollow objects, it will be assumed that this transport device is preferably configured as a mandrel wheel 02. A device 03 for transferring printing ink, e.g. a rotating or at least rotatable segmented wheel 03, along the periphery of which a plurality of printing blankets are arranged in a row, preferably cooperates with mandrel wheel 02. Assigned to segmented wheel 03, which is mentioned by way of example, and arranged along its circumferential line, a plurality of printing forme cylinders 04, in particular plate cylinders 04, that are or at least can be thrown radially onto this segmented wheel 03 are provided, with a printing forme, in particular a printing plate, being arranged on the lateral surface of each of these printing forme cylinders 04 or plate cylinders 04, said printing plate being suitable in particular for carrying out a letterpress printing process. A specific printing ink is fed by means of an inking unit 06 to each of the printing forme cylinders 04 or plate cylinders 04 for the purpose of inking up the printing forme or respectively, the printing plate thereof. In the following it will be assumed, by way of example, that each of the printing forme cylinders 04 is configured as a plate cylinder 04 that carries at least one printing plate.

Figure 2:
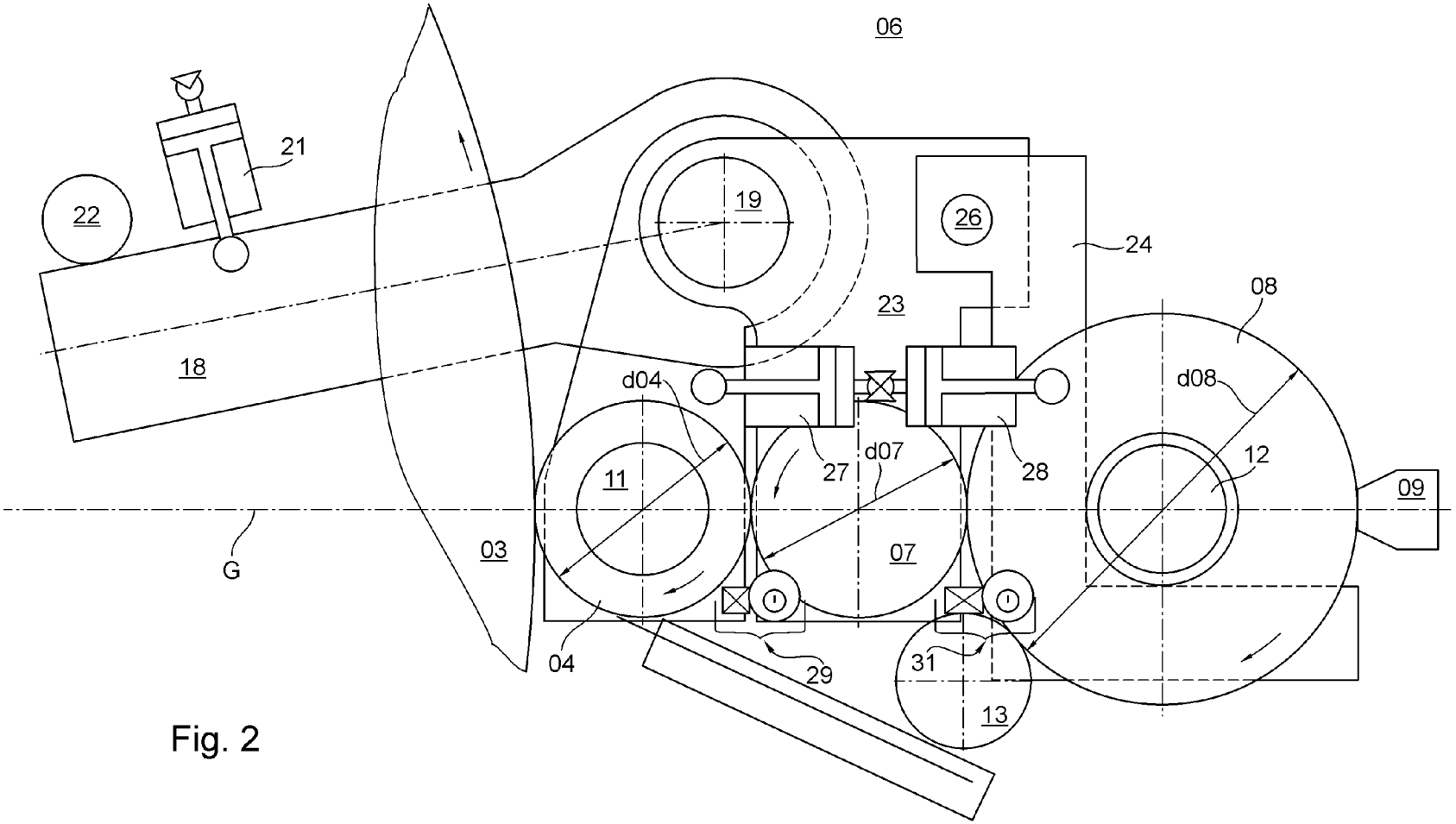
Figure 3:
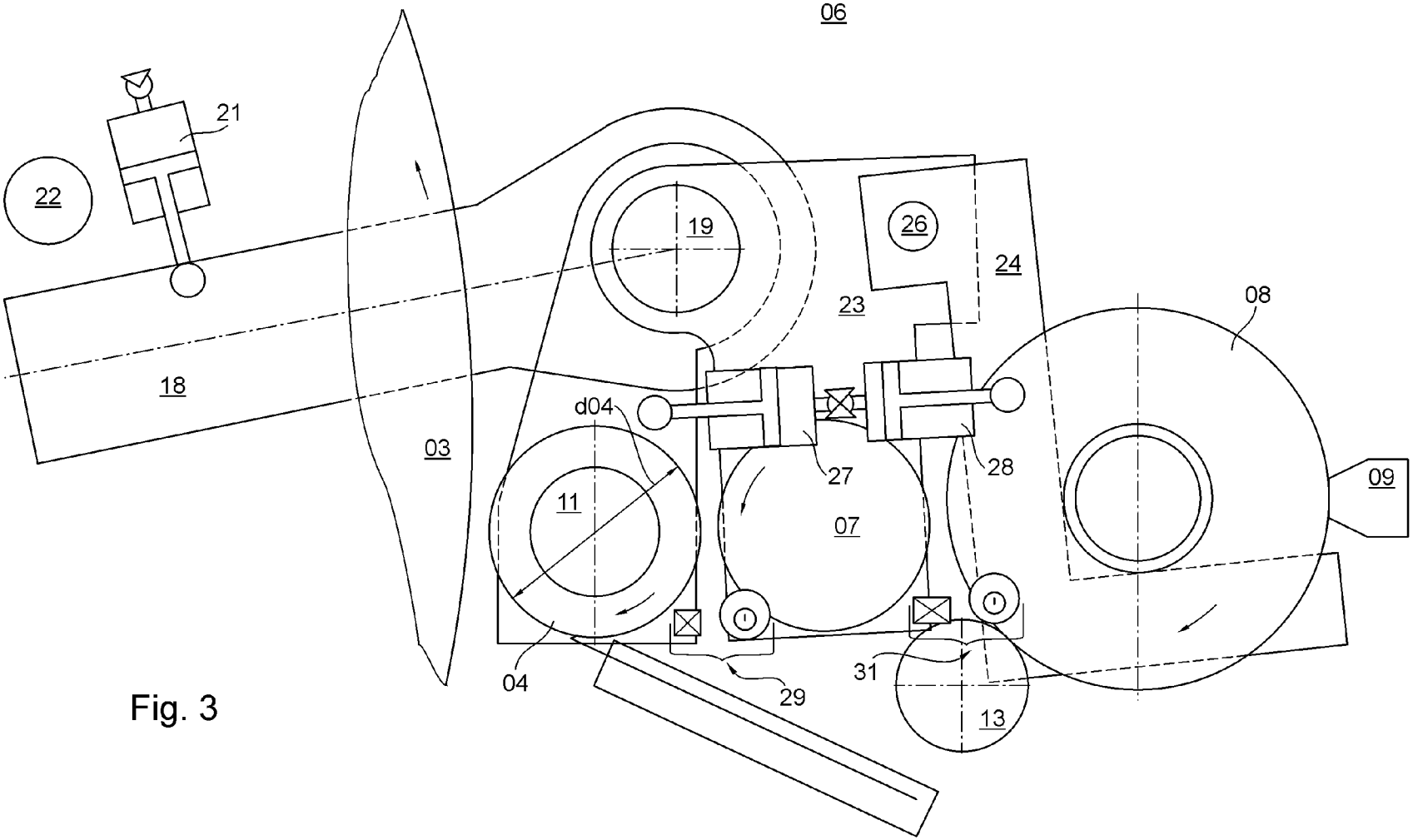

FIGS. 2 and 3 show a simplified schematic representation of a number of details of inking unit 06, one of which cooperates with each plate cylinder 04, and which is provided, e.g. for use in the device shown in FIG. 1 for printing on or for decorating in particular hollow objects 01, each of which has a preferably cylindrical lateral surface. For transporting ink from an ink reservoir to the relevant plate cylinder 04, the inking unit 06 proposed here advantageously has a very short roller train, i.e. consisting of only a few rollers, preferably a maximum of five rollers, in particular a two-roller train. In the case of the two-roller roller train, said roller train consists of only a single roller 07, e.g. inking roller 07, and a roller 08, preferably configured as an anilox roller 08, e.g. inking unit roller 08. An inking unit 06 having a roller train that consists of a maximum of five rollers is classified as a short inking unit.

FIG. 2 shows an example of a (short) inking unit 06 having a two-roller train in a first operating position, in which inking roller 07 and anilox roller 08 are thrown onto one another, inking roller 07 is thrown onto plate cylinder 04, and plate cylinder 04 is thrown radially onto the device 03 for transferring printing ink from plate cylinder 04 onto the lateral surface of the hollow object 01 in question, in particular onto the segmented wheel 03. In contrast, FIG. 3 shows a second operating position for the inking unit 06 depicted in FIG. 2, in which inking roller 07 and anilox roller 08 are thrown off of one another, inking roller 07 is thrown off of plate cylinder 04, and plate cylinder 04 is thrown off of the device 03 for transferring printing ink, in particular the segmented wheel 03. The throw-on and throw-off mechanism will be described further below.

The printing forme cylinder 04, preferably configured as a plate cylinder 04, and the inking unit roller 08, preferably configured as an anilox roller 08, are rotated, e.g. each independently, each by a motor 11; 12, in particular in the preferred inking unit 06 as shown in FIGS. 2 and 3, in which the motor 11; 12 in question is in particular controlled or at least controllable, e.g. in terms of its respective speed and/or angular position, in a closed loop e.g. by means of an electronic control unit. The device 03 for transferring printing ink, configured, e.g. as a segmented wheel 03, is rotationally driven, e.g. by a dedicated drive or by a central machine drive. inking roller 07 is or is to be rotationally driven by anilox roller 08 by means of friction. In the preferred embodiment, the outer diameter d07 of inking roller 07 is equal to the outer diameter d04 of plate cylinder 04, which carries at least one printing forme, in particular at least one printing plate. At least one printing plate is or at least can be arranged on the lateral surface of plate cylinder 04, so that in the embodiment in which the outer diameters d04; d07 are equal, the circumferential lengths of plate cylinder 04, which carries the printing plate, and inking roller 07 are also identical. In the preferred embodiment, when the inking unit 06 that cooperates with plate cylinder 04 is in the first operating position, in which inking roller 07 and anilox roller 08 are thrown onto one another, inking roller 07 is thrown onto plate cylinder 04, and plate cylinder 04 is thrown onto segmented wheel 03, at least the respective centers of plate cylinder 04, inking roller 07, and anilox roller 08 are arranged along the same straight line G. To sense the rotation of inking roller 07, a sensing device is provided, e.g. in the form of a rotary encoder, said rotary encoder being rigidly connected, in particular, to the shaft of inking roller 07. The control unit uses the signal generated by the rotary encoder when inking roller 07 is in rotation to adjust or if necessary to track the rotational speed and/or angular position of inking roller 07 by means of the rotation of anilox roller 08 such that synchronization between plate cylinder 04 and inking roller 07 is or will be established, so that the circumferential speed of inking roller 07 coincides with the circumferential speed of plate cylinder 04 within predefined permissible tolerance limits. To achieve this goal, it can be provided that the control unit adjusts the circumferential speed of anilox roller 08, preferably during the adjustment phase carried out by the control unit, such that the anilox roller has in particular a brief, and thus not permanent, lead time or lag time in relation to the circumferential speed of plate cylinder 04. By configuring plate cylinder 04 and inking roller 07 as having equal circumferential lengths, and by adjusting the synchronization between plate cylinder 04 and inking roller 07, the adverse effect of ghosting on print quality is largely avoided. The drive concept described herein involving a friction-driven inking roller 07 also has the advantage that a separate drive is not required for inking roller 07, which saves on costs and also facilitates replacement of inking roller 07, e.g. during maintenance and repair operations, due to the simpler mechanical construction.

In its preferred embodiment, inking roller 07 has a closed, preferably rubberized lateral surface. Inking unit roller 08, preferably configured as anilox roller 08, has a lateral surface coated, e.g. with a ceramic, with a hachure, e.g. of 80 lines per centimeter of axial length of anilox roller 08 or a saucer structure being formed in the ceramic layer. To enable the largest possible volume of printing ink to be fed into the roller train of inking unit 06 with each revolution of anilox roller 08, the outer diameter d08 of anilox roller 08 is preferably configured as larger than the outer diameter d07 of inking roller 07. This is meant to give anilox roller 08 the greatest possible delivery volume. In FIG. 2, the respective directions of rotation of segmented wheel 03, plate cylinder 04, inking roller 07, and anilox roller 08 are each indicated by a rotational arrow.

In the preferred embodiment, at least the inking unit roller 08, preferably configured as anilox roller 08, has a temperature control device for controlling the temperature of the lateral surface of said roller. The temperature control device of anilox roller 08 operates e.g. using a temperature control fluid that is introduced into the interior of anilox roller 08, the temperature control fluid being, e.g. water or some other liquid coolant. The temperature control device of anilox roller 08 can be used to influence the delivery volume of anilox roller 08, as said device influences the viscosity of the printing ink to be transported by inking unit 06. The delivery volume of anilox roller 08 and the viscosity of the printing ink to be transported by inking unit 06 in turn ultimately impact the ink density of the printing ink to be applied to the cylindrical lateral surface of the hollow object 01 to be printed. The thickness of an ink film formed by the printing ink to be applied to the cylindrical lateral surface of hollow object 01 to be printed on is, e.g. about 3 μm.

Figure 4:
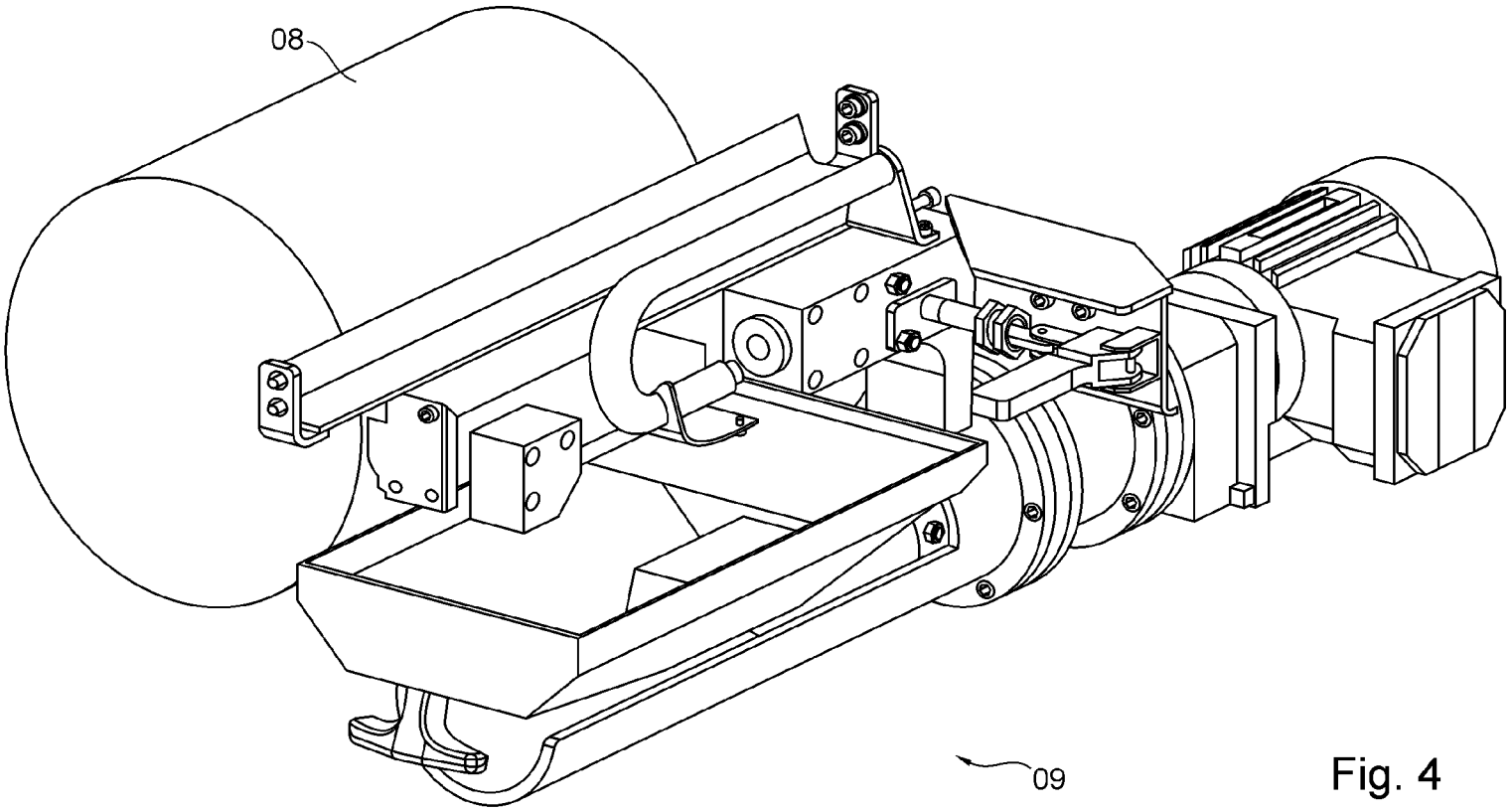
Figure 5:
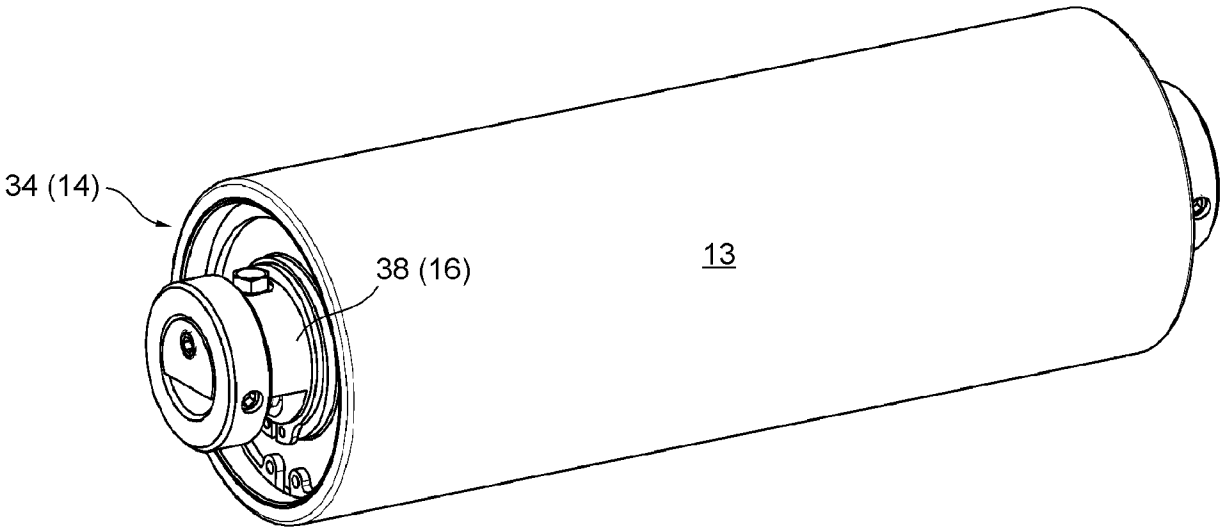
Figure 6:
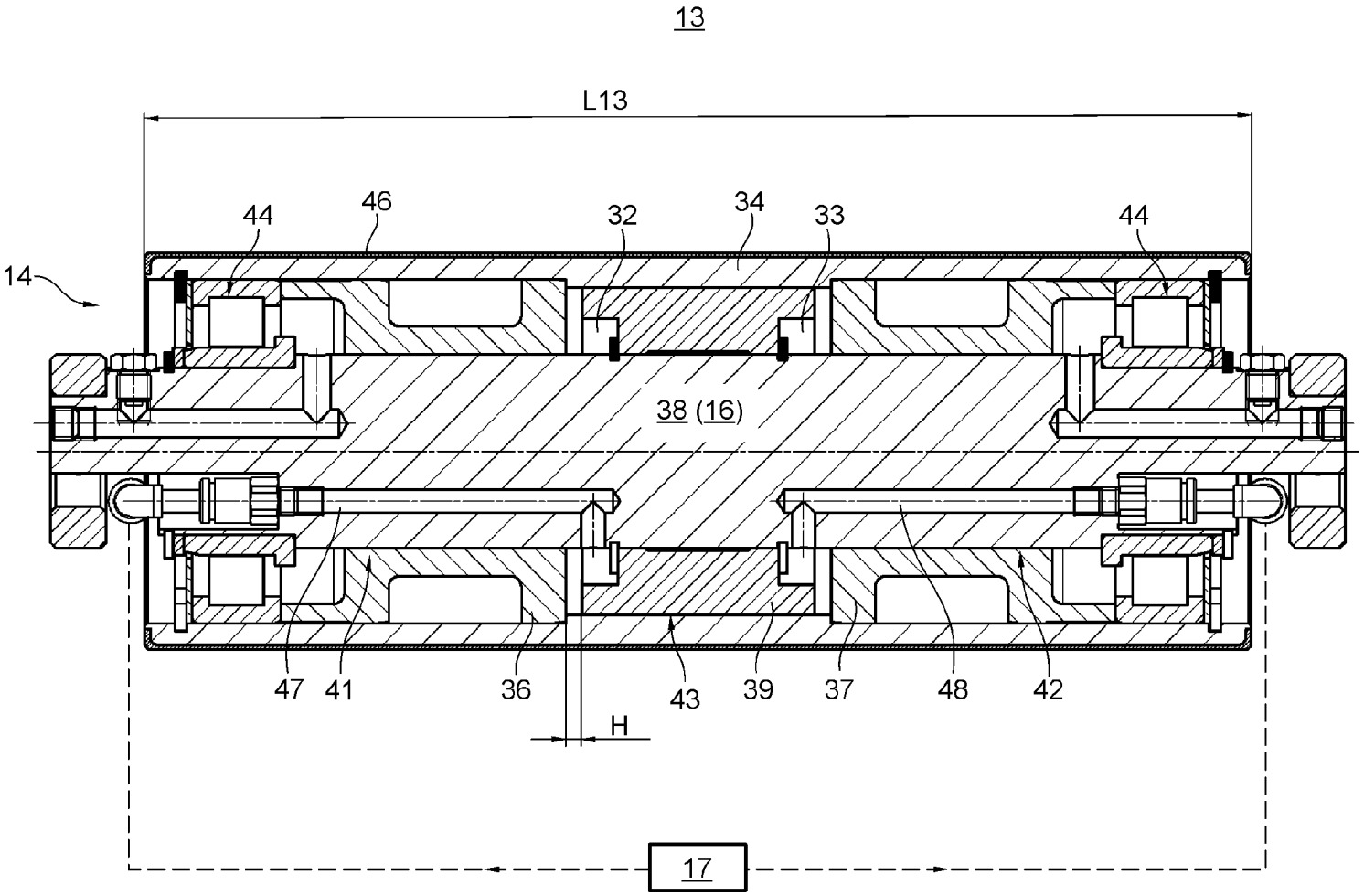

The ink reservoir of inking unit 06 is embodied, e.g. as a chamber doctor blade system 09 that operates in conjunction with anilox roller 08. Advantageously, in this chamber doctor blade system 09, at least one ink trough, a doctor blade bar that is or at least can be set axially parallel against anilox roller 08, and preferably also a pump for delivering the printing ink form a single modular unit. This chamber doctor blade system 09 is preferably held or mounted in inking unit 06, i.e. on a frame of inking unit 06, on only one side by means of a suspension, for example, so that once this modular unit has been released from the frame of inking unit 06 it can be easily removed from inking unit 06 laterally, i.e. by a movement directed axially parallel to anilox roller 08, e.g. by pulling on a handle arranged on said structural unit, and can thus be replaced. This modular unit of chamber doctor blade system 09 preferably forms a cantilever arm on a side frame of inking unit 06. FIG. 4 shows a perspective view of chamber doctor blade system 09, configured as a separate modular unit, in cooperation with anilox roller 08 of inking unit 06.

Once anilox roller 08 has received printing ink from the ink reservoir, i.e. in particular from chamber doctor blade system 09, anilox roller 08 transports this printing ink immediately and directly or via additional rollers of the roller train that is part of inking unit 06 to the preferably only one inking roller 07.

To ensure a better ink distribution in the inking unit 06, one roller 13 of the inking unit 06 is preferably embodied as oscillating roller 13, e.g. distribution roller 13. Such a distribution roller 13 can be provided directly in the roller train of an inking unit 06 embodied as a roller inking unit, but in the embodiment depicted here is embodied as what is known as a rider roller 13, which cooperates with the circumferential surface of one of the rollers 07; 08 of inking unit 13, in particular of short inking unit 06. In the advantageous embodiment depicted here, said distribution roller is configured as an oscillating rider roller 13 that cooperates with the lateral surface of anilox roller 08.

The oscillating distribution roller 13, embodied here by way of example as rider roller 13, preferably is or at least can be thrown onto anilox roller 08, e.g. in a region between chamber doctor blade system 09 and inking roller 07, downstream of the chamber doctor blade system 09 thrown onto anilox roller 08 in the direction of rotation of anilox roller 08, in order to improve the uniformity of ink application to anilox roller 08 and the transport of ink by said roller. Rider roller 13 is arranged axially parallel to anilox roller 08. In contrast to other possible embodiments, the distribution roller 13 configured here as rider roller 13 is not regarded as part of the roller train of inking unit 06, since it does not transfer printing ink from anilox roller 08 to another roller. Rider roller 13, which is rotationally driven by anilox roller 08, e.g. by means of friction, has a rubberized lateral surface, for example. Distribution roller 13 can also generally be driven by a motor directly via a gear mechanism. As rider roller 13, which is thrown onto anilox roller 08, rolls off against the lateral surface of anilox roller 08, it draws a portion of the printing ink that has been received by anilox roller 08 from chamber doctor blade system 09 out of the hachure or the saucers of anilox roller 08 and deposits at least some of this printing ink onto lands that are formed on the lateral surface of anilox roller 08. Rider roller 13 rolling off against anilox roller 08 thus causes anilox roller 08 to deliver a greater volume of printing ink to inking roller 07. As another consequence, with an anilox roller 08 that has, e.g. a temperature control device, the efficacy of controlling the ink density is also improved in that the rider roller 13 rolling off against anilox roller 08 contributes to supplying a greater volume of printing ink. Regardless of the specific configuration of anilox roller 08, i.e. with or without a temperature control device, rider roller 13 rolling off against anilox roller 08 thus reduces both differences in density that may occur as a result of manufacturing tolerances of anilox roller 08 and the risk that the hachure or saucers of anilox roller 08 may be visible on the printing substrate, i.e. in this case on the lateral surface of hollow object 01 to be printed, as a result of an insufficient application of ink at least in patches.

The respective throwing on and/or throwing off of printing forme cylinder or plate cylinder 04, inking roller 07, and/or anilox roller 08 and/or the adjustment of the contact pressure exerted by each of these is carried out by means of a throw-on/throw-off mechanism, illustrated by way of example in FIGS. 2 and 3, which will now be described in detail. In the preferred embodiment, the printing forme cylinder or plate cylinder 04 is mounted, in particular at both ends, on a load arm of a first, preferably one-sided lever assembly 18, consisting of a force arm and the load arm, wherein the force arm and the load arm, which is arranged at a fixed angle relative to the force arm, of this first lever assembly 18 can be pivoted jointly about a first rotational axis 19, directed axially parallel to plate cylinder 04. A first drive 21, e.g. in the form of a hydraulic or pneumatic working cylinder and preferably controllable by a control unit, is operatively connected to the force arm of the first lever assembly 18 for the purpose of applying torque about the first rotational axis 19, wherein upon actuation of this first drive 21, the printing forme cylinder or plate cylinder 04 arranged on the load arm of this first lever assembly 18 is either thrown off of a printing blanket, e.g. of the segmented wheel 03 or thrown onto the same, depending upon the direction of action of said drive. To limit the contact pressure exerted by the printing forme cylinder or plate cylinder 04 against the printing blanket in question, e.g. of segmented wheel 03, a first stop 22 which limits the path traveled by the pivoting movement of the printing forme cylinder or plate cylinder 04 toward segmented wheel 03 is provided, for example for the force arm of the first lever assembly 18. The contact pressure exerted by the printing forme cylinder or plate cylinder 04 against segmented wheel 03 can be adjusted using the first drive 21.

In the preferred embodiment, inking roller 07 is also mounted, in particular at both ends, on a load arm of a preferably one-sided second lever assembly 23, consisting of a force arm and the load arm, wherein the force arm and the load arm of this second lever assembly 23 are pivotable jointly about the first rotational axis 19, which is aligned axially parallel to plate cylinder 04. Likewise in the preferred embodiment, inking unit roller 08, embodied, e.g. as an anilox roller 08, is also mounted in particular at both ends on a load arm of a preferably one-sided third lever assembly 24 consisting of a force arm and the load arm, wherein the force arm and the load arm of this third lever assembly 24 are pivotable together about a second rotational axis 26, which is aligned axially parallel to anilox roller 08, the second rotational axis 26 of the third lever assembly 24 being disposed on the second lever assembly 23. The second rotational axis 26 on the second lever assembly 23 is preferably fixed. On the load arm of the first lever assembly 18, a preferably controllable second drive 27 is arranged, which when actuated acts on the force arm of the second lever assembly 23, and which can be used to throw inking roller 07 onto or off of plate cylinder 04, depending upon the direction of action of second drive 27. On the load arm of the second lever assembly 23, a preferably controllable third drive 28 is arranged, which when actuated acts on the force arm of the third lever assembly 24, and which can be used to throw anilox roller 08, preferably together with chamber doctor blade system 09, onto or off of inking roller 07, depending on the direction of action of third drive 28. The second drive 27 and/or the third drive 28 is/are each also embodied, e.g. in the form of a hydraulic or pneumatic working cylinder. It can be provided that second drive 27 and third drive 28 are or at least can be actuated, e.g. jointly and preferably also simultaneously. The pivoting movement of the load arm of the second lever assembly 23 is limited, e.g. by a first stop system 29 that is preferably adjustable, in particular by means of an eccentric, whereby the contact pressure exerted by inking roller 07 against printing forme cylinder or plate cylinder 04 is or at least can be limited. The pivoting movement of the load arm of the third lever assembly 24 is limited, e.g. by a second stop system 31, which is preferably adjustable, in particular by means of an eccentric, whereby the contact pressure exerted by anilox roller 08 against inking roller 07 also is or at least can be limited. FIG. 2 shows a first operating state, by way of example, in which the first drive 21 and the second drive 27 and the third drive 28 are not actuated, or each is in its idle state, in which anilox roller 08 is thrown onto inking roller 07, and inking roller 07 is thrown onto printing forme cylinder or plate cylinder 04, and printing forme cylinder or plate cylinder 04 is thrown onto segmented wheel 03. FIG. 3 shows a second operating state, by way of example, in which the first drive 21 and the second drive 27 and the third drive 28 are actuated, or each is in its working state, in which anilox roller 08 is thrown off of inking roller 07, and inking roller 07 is thrown off of printing forme cylinder or plate cylinder 04, and printing forme cylinder or plate cylinder 04 is thrown off of segmented wheel 03. The respective force arm and/or load arm of each of the three aforementioned lever assemblies 18; 23; 24 is or are each configured, e.g. as a pair of opposing lever rods or side frame walls, between which either the printing forme cylinder or plate cylinder 04 or the inking roller 07 or the anilox roller 08 is arranged, each in its respective assignment as described above. Each of the three aforementioned lever assemblies 18; 23; 24 is arranged in a different vertical plane, spaced apart from the others, so that none of the lever assemblies can impede the pivoting of the others.

Generally independently of the specific embodiment of the printing press, the printing unit, and/or the inking unit 06, but advantageously in conjunction with the aforementioned embodiment, and generally independently of the configuration of the inking unit 06 and/or the positioning of distribution roller 13, but advantageously in conjunction with the aforementioned arrangement in a short inking unit 06 and/or with the embodiment as a rider roller 13, oscillating roller 13 is embodied as a pneumatic oscillating roller 13, as described in the following.

Roller 13 comprises a roller outer body 14, which is mounted on a roller inner body 16 so as to be movable axially in a reciprocating manner, the reciprocating movement being effected by a pneumatic drive. Compressed air is supplied via valves, for example, from a compressed air source 17, which is indicated only schematically. For movement, at least one chamber 32; 33, which is formed in the roller interior in the manner of a cylinder/piston system between one or more structural elements 34; 36; 37, e.g. composed of one or more parts and fixed to the roller outer body, and one or more structural elements 38; 39, e.g. component parts 38; 39, composed of one or more parts and fixed to the roller inner body, can be pressurized with compressed air.

The reciprocating movement is generally achieved in both directions pneumatically by pressurizing two such chambers 32; 33 alternatingly with compressed air, or in only a first direction pneumatically by pressurizing one chamber 32; 33 with compressed air counter to a spring force and back in the second direction by way of the spring force with the compressed air switched off or under reduced pressure.

In the preferred first embodiment depicted here, for the reciprocating movement a first and a second chamber 32; 33, each of which is formed in the manner of a cylinder/piston system inside the roller between one or more structural elements 34; 36; 37 that are fixed to the roller outer body and one or more structural elements 38; 39, e.g. component parts 38; 39, composed of one or more parts and fixed to the roller inner body, can be selectively pressurized with compressed air. The (respective) structural element 34; 36; 37 fixed to the roller outer body may be formed by a cylindrical roller shell body 34 of the roller outer body 14 itself or preferably by structural elements 36; 37, in particular bushings 36; 37, formed on or set into said roller shell body, on the inner side thereof. The structural element 38; 39 fixed to the roller inner body can be formed by a cylindrical axle 38 or shaft 38 of the roller inner body 16 itself, or preferably by a structural element 39, in particular a ring 39, molded or placed onto the outer surface of said roller inner body.

Figure 7:
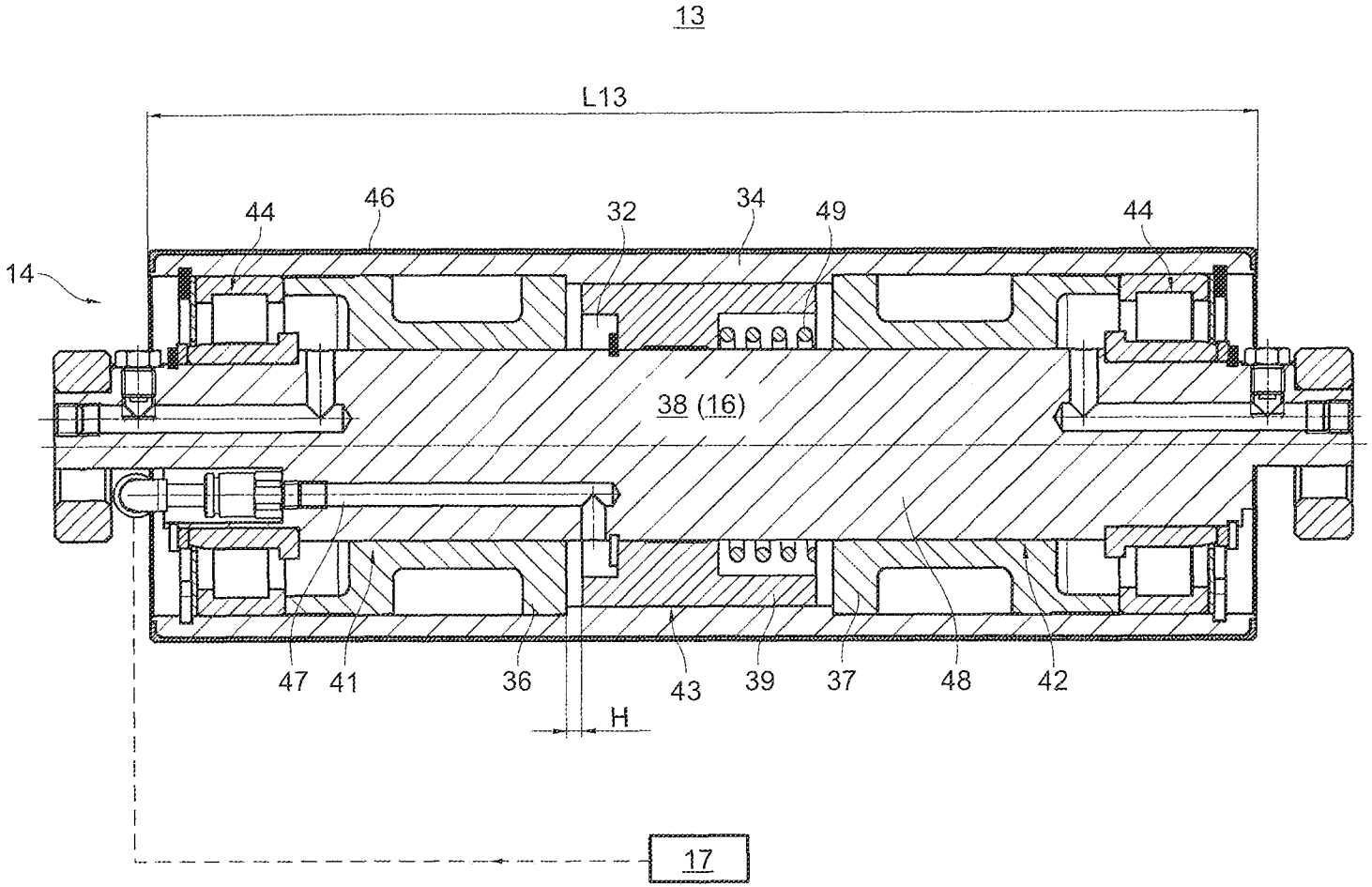

In an alternative embodiment, shown in FIG. 7, in place of the second chamber 33 that can be pressurized alternately to the first chamber 32 and is located between roller outer body 14 and roller inner body 16, a spring element 49 is provided, which spring element 49 is or can be biased in the first direction with a force acting and/or directed in the opposite direction as a result of an axial movement of the roller outer body 14, induced by pressurization with compressed air. The spring element 49 is arranged between roller outer body 14 and roller inner body 16 such that when the pressure in the first chamber 32 is reduced or eliminated, the spring element 49 moves roller outer body 14 back in the direction opposite the first direction. The spring element 49 is embodied, for example, as a type of compression spring, which is compressed when chamber 32 is pressurized with compressed air and which moves roller outer body 14 back in the opposite direction when the air pressure is reduced, or said spring element 49 is embodied as a type of tension spring, which is stretched when chamber 32 is pressurized with compressed air and which moves roller outer body 14 back in the opposite direction when the air pressure is reduced.

But independently of the specified embodiment of the pneumatic drive, in one or in both directions, the parts of the structural elements 34; 36; 37; 38; 39 that delimit the respective chamber 32; 33 and are movable axially relative to one another are not embodied here as seals acting mechanically as a barrier and/or are not sealed off from one another by way of significant physical contact, but instead form a non-contact seal 41; 42; 43 between themselves on their mutually facing sides. Although they can also be embodied as having one or more grooves or as single-passage or multiple-passage labyrinth seals, the non-contact seals 41; 42; 43 are preferably embodied here as simple gap seals 41; 42; 43, and/or no mechanically acting seal, i.e. no seal that acts between parts by physical, in particular force-loaded contact, is provided between these parts that are axially movable relative to one another. Preferably, a gap width, i.e., a clear width, of at least 0.03 mm, preferably at least 0.05 mm, is provided. Preferably, a gap width of at most 0.15 mm, preferably at most 0.10 mm, is provided.

The axial length of gap seal 41; 42; 43 adjoining chamber 32; 33 is greater than three times a maximum axial stroke H and/or greater than two times an axial extension of chamber 32; 33 and/or greater than one-tenth of the cylinder barrel length L13, in particular the usable cylinder barrel length. The length here should be understood, e.g., as the length that acts as a gap seal between the parts concerned, which are movable relative to one another and are to be sealed, i.e. the length that does not exceed the aforementioned maximum gap width. If sub-sections interrupted by grooves are provided between the two parts of the structural elements 34; 36; 37; 38; 39 concerned that are movable relative to one another and are to be sealed relative to one another, said length can be the sum of the lengths in the axial direction.

The two chambers 32; 33 are preferably provided on the two sides of annular structural element 39, which is fixed to the roller inner body, and each is delimited at its end face by a bushing-like structural element 36; 37, which is fixed to the roller outer body.

In an advantageous embodiment, a non-contact seal 41; 42; 43, in particular a gap seal 41; 42; 43, is provided between the outwardly facing side of structural element 39, which is fixed to the roller inner body, and the inwardly facing side of roller outer body 14, in particular of a cylindrical roller shell body 34, and/or between the inwardly facing side of the respective structural element 36; 37, which is fixed to the roller outer body, and an outwardly facing side of roller inner body 16, in particular of a shaft 38 or axle 38 that supports roller outer body 14.

The surfaces of the mutually facing sides between which the non-contact seal 41; 42; 43 is housed have a roughness with an average roughness depth Rz (DIN ISO 1302) of at most 10, for example, preferably of at most 4.

Roller inner body 16 preferably comprises or is embodied as an axle 38 that supports roller outer body 14 via roller bearings 44. The two chambers 32; 33 are preferably supplied with compressed air, each from one end face of the roller, via corresponding channels 47; 48, e.g. bores 47; 48 through stub shafts that protrude outward from the end faces of roller 13.

In that case, roller bearing 44 can have a running surface that is widened by at least the lateral stroke of roller 13.

Roller shell body 34, which is part of roller outer body 14, preferably carries on its lateral surface a plastic layer 46, in particular a layer 46 of Rilsan®, or is made of such a material.

The embodiment of roller 13 with the non-contact seal can also be used particularly advantageously for printing units that have larger roller widths, e.g. for printing units for waterless offset printing that have a roller or printing width of 1,000 mm or more. This enables the large mass of roller outer body 14 to be moved pneumatically without large additional friction losses, as is the case with seals.

While a preferred embodiment of an oscillating roller and a printing press having a plurality of printing units that each have such an oscillating roller, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A roller of a printing unit of a printing press, which printing unit includes a roller inking unit, the roller being a part of the roller inking unit, the roller comprising:

a roller axle having an axle outer circumferential surface, the roller axle forming a roller inner body;

a roller outer body supported on the roller inner body for axial movement, in a reciprocating manner, with respect to the roller inner body, and having a roller outer body cylindrical shell including a roller outer body cylindrical shell inner circumferential surface;

a pneumatic drive to effect the axial movement of the roller outer body with respect to the roller inner body in at least a first axial direction;

at least a first chamber in an interior of the roller and forming the pneumatic drive as a piston/cylinder system;

a compressed air source to supply compressed air to the at least first chamber and to exhaust compressed air from the at least first chamber to form the pneumatic drive;

a roller inner body annular ring on the axle outer circumferential surface and having a roller inner body annular ring outer circumferential surface;

at least a first annular bushing on the inner circumferential surface of the roller outer body cylindrical shell and having a first annular bushing inner circumferential surface, the roller outer body cylindrical shell inner circumferential surface, the roller inner body annular ring and the at least first annular bushing forming the at least first chamber;

a first non-contact seal between the roller outer body cylindrical shell inner circumferential surface and the roller inner body annular ring outer circumferential surface; and a second non-contact seal between the axle outer circumferential surface and the inner circumferential surface of the at least first annular bushing, each of the first non-contact seal and the second non-contact seal having a gap width of at most 0.15 mm.

2. The roller according to claim 1, wherein a spring force-based drive is provided, by means of which spring force-based drive an axial movement of the roller outer body can be effected in a second axial direction opposite to the first axial direction.

3. The roller according to claim 1, further including a second annular bushing having a second annular bushing inner circumferential surface, and wherein a second chamber is formed in the interior of the roller as a second cylinder/piston system between the roller body outer cylindrical shell inner circumferential surface, the roller inner body annular ring and the second annular bushing and which second chamber can be pressurized with compressed air to bring about an axial movement of the roller outer body in a second axial direction opposite the first axial direction, and wherein the roller body outer cylindrical shell inner circumferential surface and the second annular bushing inner circumferential surface form a third non-contact seal.

4. The roller according to claim 3, wherein the first and second chambers are provided on first and second axially spaced sides of the roller inner body annular ring.

5. The roller according to claim 3, wherein the first and second chambers are each supplied with compressed air from the compressed air source, each from one of first and second end faces of the roller, through stub shafts that protrude outward from the first and second end faces of the roller.

6. The roller according to claim 3, wherein a spring element is arranged in the second chamber between the roller inner body and the second annular bushing and which spring element is biased in the first axial direction with a force acting in a direction opposite to the first axial direction in response to an axial movement of the roller outer body induced by pressurization of the first chamber with compressed air, from the compressed air source and wherein, when the pressurization of the first chamber is one of reduced and eliminated, the spring element moves the roller outer body axially opposite the first axial direction.

7. The roller according to claim 1, wherein an axially extending length of the first non-contact seal adjoining the first chamber is one of greater than three times a maximum axial stroke and is greater than two times an axial extension of the first chamber and is greater than one-tenth of a usable cylinder barrel length of the roller.

8. The roller according to claim 1, wherein surfaces of mutually facing sides of the roller outer body cylindrical shell inner circumferential surface and the roller inner body ring, and between which mutually facing sides the first non-contact seal is formed, and wherein surfaces of the mutually facing sides of the axle outer circumferential surface and the inner circumferential surface of the at least first annular bushing, and between which mutually facing sides the second non-contact seal is formed, each have a roughness with an average roughness depth Rz of at most 10.

9. The roller according to claim 1, wherein the axle supports the roller outer body via roller bearings.

10. A printing press for decorating hollow objects, each of which hollow objects has a cylindrical lateral surface, using a plurality of printing units, each of which plurality of printing units comprises a forme cylinder and an inking unit and each of which inking units cooperate, via its associated forme cylinder, with a printing blanket of a device for transferring the printing ink to the hollow object to be printed, wherein each inking unit comprises a distribution roller, embodied as the roller of the printing unit according to claim 1.

11. The printing press according to claim 10, wherein each inking unit has an anilox roller.

* * * * *